US009173442B2

(12) United States Patent
Tyson et al.

(10) Patent No.: US 9,173,442 B2
(45) Date of Patent: Nov. 3, 2015

(54) CLOTHING FASTENER ACCESSORY AND EXTENDER SYSTEM

(71) Applicants: Dennis D. Tyson, Cuyahoga Falls, OH (US); Kathy M. Tyson, Cuyahoga Falls, OH (US)

(72) Inventors: Dennis D. Tyson, Cuyahoga Falls, OH (US); Kathy M. Tyson, Cuyahoga Falls, OH (US)

(73) Assignee: Eagle Leather, Inc., Cuyahoga Falls, OH (US)

( * ) Notice: Subject to any disclaimer, the term of this patent is extended or adjusted under 35 U.S.C. 154(b) by 320 days.

(21) Appl. No.: 13/683,437

(22) Filed: Nov. 21, 2012

(65) Prior Publication Data

US 2014/0137315 A1 May 22, 2014

(51) Int. Cl.

| | |
|---|---|
| ***A41F 3/02*** | (2006.01) |
| ***A41F 1/00*** | (2006.01) |
| ***A44B 99/00*** | (2010.01) |

(52) U.S. Cl.

CPC .. *A41F 1/00* (2013.01); *A44B 99/00* (2013.01)

(58) Field of Classification Search

CPC ..... A41F 1/00; A41F 3/02; A44B 99/00; A41D 27/08

USPC ..... 2/316, 338, 244, 245, 340; 24/3.13, 24/67.3, 67.9, 113 R, 455, 489; 411/175, 411/970; 269/45

See application file for complete search history.

(56) References Cited

U.S. PATENT DOCUMENTS

| | | | | |
|---|---|---|---|---|
| 1,406,390 | A * | 2/1922 | Jasgur | 24/690 |
| D81,660 | S | 5/1930 | Negbaur | |
| 2,298,568 | A * | 10/1942 | Kost | 411/175 |
| 3,388,732 | A * | 6/1968 | Holton | 411/167 |
| D295,501 | S | 5/1988 | Brayford | |
| D301,017 | S | 5/1989 | Norman et al. | |
| 4,959,890 | A | 10/1990 | Pazurek | |
| 5,176,269 | A | 1/1993 | Herman | |
| 5,337,584 | A | 8/1994 | Angeli | |
| 5,621,951 | A | 4/1997 | Gould | |
| 6,035,494 | A | 3/2000 | Duke et al. | |
| 6,038,702 | A * | 3/2000 | Knerr | 2/244 |
| 6,647,555 | B2 * | 11/2003 | Yamaguchi et al. | 2/338 |

(Continued)

OTHER PUBLICATIONS

Jamestown Distributors, Nylon Flat Washers, published online on Nov. 9, 2007 (https://web.archive.org/web/20071109121956/http://www.jamestowndistributors.com/userportal/show_product.do?pid=6351).*

(Continued)

*Primary Examiner* — Clinton T Ostrup
*Assistant Examiner* — Abby Spatz
(74) *Attorney, Agent, or Firm* — Hudak, Shunk & Farine Co. LPA

(57) ABSTRACT

A device, namely a detactable fastener accessory that can be used to cover a fastener, preferably a snap cover of an article of clothing, the accessory having or adapted to have a decorative cover piece connected thereto. In a further embodiment, the fastener accessory is part of an extender system that allows an article of clothing such as a vest or jacket to have a greater size by connecting an extension segment, such as a chain, piece of leather or other fabric, between fasteners on opposite sides of the article of clothing, which at least provides the advantages of allowing a user to achieve better ventilation or airflow while riding a motorcycle and also prevents the article of clothing from being blown out of a desired position. When used in the extender system, the fastener accessory allows for matching decorative pieces to be displayed on each side of the article of clothing.

4 Claims, 3 Drawing Sheets

(56) References Cited

U.S. PATENT DOCUMENTS

| | | | | |
|---|---|---|---|---|
| D521,893 | S | 5/2006 | Reidy | |
| D581,311 | S | 11/2008 | Cornett | |
| 2006/0162051 | A1* | 7/2006 | Bachechi | 2/338 |
| 2008/0313864 | A1 | 12/2008 | Suter | |
| 2010/0235965 | A1* | 9/2010 | Frandsen et al. | 2/237 |
| 2012/0117763 | A1 | 5/2012 | Patel | |

OTHER PUBLICATIONS

Plastics International, Hardness Scale- Durometer Comparisons of Materials, 2014 (http://www.plasticsintl.com/polyhardness.htm).*

Hardness Testing of Materials, Sep. 22, 2013 (https://web.archive.org/web/20130922003856/http://lennon.csufresno.edu/~mhk03/hardness_1.htm).*

Oxforddictionaries.com, Washer, accessed May 22, 2015, http://www.oxforddictionaries.com/us/definition/american_english/washer.*

Picture Hood U Clip—http://yankeecr.accountsupport.com/cgi-bin/catalog/picserye.cgi?picserve=/Hood-U-Clip . . . date at least as early as Sep. 10, 2012.

Picture of Clips—http://www.taiwantrade.com.tw/resources/member/115216/productcatalog/c01fbccb-edf2- . . . date at least as early as Sep. 10, 2010.

* cited by examiner

CLOTHING FASTENER ACCESSORY AND EXTENDER SYSTEM

FIELD OF THE INVENTION

The present invention relates to a device, namely a detactable fastener accessory that can be used to cover a fastener, preferably a snap cover of an article of clothing, the accessory comprising or adapted to have a decorative cover piece connected thereto. In a further embodiment, the fastener accessory is part of an extender system that allows an article of clothing such as a vest or jacket to have a greater size by connecting an extension segment, such as a chain, piece of leather or other fabric, between fasteners on opposite sides of the article of clothing, which at least provides the advantages of allowing a user to achieve better ventilation or airflow while riding a motorcycle and also prevents the article of clothing from being blown out of a desired position. When used in the extender system, the fastener accessory allows for matching decorative pieces to be displayed on each side of the article of clothing.

BACKGROUND OF THE INVENTION

Many different devices have been employed to cover or decorate fasteners, such as buttons and snaps. Vest extenders have been used in the art to extend the size of an article of clothing such as a jacket or vest and provide ventilation.

U.S. Patent Publication 2012/0117763 relates to a slidable button cover that can be attached to a cuff button and/or a shirt button on a shirt of a type comprising a cuff button and/or a shirt button. More specifically, this invention relates to a slidable button cover that can be attached on a shirt of a type comprising a cuff, a shirt, a cuff and/or shirt button and a cuff and/or shirt button hole, said cuff and/or shirt button reportedly securely engaging said cuff and/or shirt button, and a slidable button cover with a decorative face on the top of said slidable button cover with an attaching means on the bottom of said slidable button cover capable of sliding over and engaging said cuff and/or shirt button thread, said cuff and/or shirt button reportedly resting securely within the attaching means and beneath the bottom of the slidable button cover.

U.S. Patent Publication 2008/0313864 relates to a one piece detachable button cover adapter for converting a plain jean button into a more decorative one. This device is comprised of a substantially flat, circular disc with resilient prongs. An ornamental top is attached to the front side of this adapter and resilient prongs on the back side hold a jean button. The reported advantage of this invention is that it covers and securely holds a jean button whereas a typical button cover does not. Another reported advantage is that this adapter does not utilize a cup and/or hinge and therefore produces a more attractive, sleeker button cover that is easy to attach to and detach from a jean button.

U.S. Pat. No. 5,621,951 relates to a plastic device for detachably covering and concealing a button employs a first horizontal plate having at least one opening therein. A second horizontal plate spaced from the first plate is secured to one end of a hollow cylinder having opposite open ends and closes same. A living hinge integrally secures a portion of the periphery of the other open end of the cylinder to a peripheral portion of the first plate. The device has an open position at which the other end of the cylinder is out of engagement with the first plate and has a closed position at which said other end of the cylinder is in mating engagement with the first plate. The cylinder and the first plate are provided with detachable locking engagement means which are spaced apart when the device is in the open position and which are disposed in locking engagement when the device is in closed position.

U.S. Pat. No. 5,337,584 relates to a convertible jewelry article includes a button cover and a pair of inserts for converting the button cover for use as a pin or a clip-on earring. The button cover includes a cover portion having an open back and a back plate hinged to the cover so that it is hingeably received over the open back. The back plate includes an opening for receiving button attachment means therein, and resilient clip members for releasably maintaining the back plate in closed relation over the open back. The pin insert includes an insert body, a raised surface on one side thereof and a pin projecting outwardly from the raised surface. The earring insert is generally similar but includes a spring loaded earring clamp instead of a pin. Both of the inserts are adapted to be received in the cover portion so that the raised surface is received in interfitting engagement with the opening in the back plate when the back plate is in closed relation over the open back of the button cover. When assembled with the button cover, the pin or the earring clamp extends outwardly of the back plate through the opening therein.

U.S. Pat. No. 5,176,269 relates to rib and groove snap-type action securing elements formed respectively on closure bases and caps so that a number of different closure caps can be disposed for co-action with a single base to fabricate a number of different closure assemblies.

SUMMARY OF THE INVENTION

In view of the above, it would be desirable to provide a detachable extender system for an article of clothing, the extender system having matching cover pieces to provide at least aesthetic balance to the article, and in particular provide a fastener accessory that can be operatively connected to an article of clothing with an extension segment.

One object of the invention is to provide a fastener accessory that has an opening that can be inserted over a fastener, preferably female, of an article of clothing, wherein the fastener accessory covers at least a portion of the fastener.

Yet another object is to provide a fastener accessory having an inner flange with an aperture having a diameter larger than a diameter of a fastener such that a portion of the fastener can be extended through the flange aperture.

Still another object is to provide a fastener accessory having an outer flange with an aperture concentric with the inner flange aperture, yet having a smaller diameter.

A further object of the present invention is to provide the inner flange with an aperture that is at least 50 percent or at least 60 percent larger than the diameter of the outer flange.

Still another object of the present invention is to provide the fastener accessory with a protective device, such as a coating, washer or pad, in some embodiments connected to an inner surface of the outer flange, the protective device having a hardness less than a hardness of the outer flange in order to protect a fastener of an article of clothing from being abraded or scratched by the fastener accessory of the present invention. For, example the protective coating can be a soft material such as foam, felt, polymer or the like.

Yet another object of the present invention is to provide a fastener accessory having a cover piece connected to the fastener such that at least a portion of the cover piece is present on an outer surface of the outer flange, wherein in one embodiment the cover piece is removably attachable to the outer flange through an aperture present in the outer flange.

Another object of the present invention is to provide an extender system comprising an extension segment having a female fastener, a male fastener and a rigid or flexible linking segment operatively connected between the fasteners, wherein the fastener accessory inner flange has an aperture size such that a portion of the male fastener can extend through the inner flange aperture and connect the fastener assembly and a portion of the extension segment to a female fastener of an article of clothing.

In one aspect of the present invention, a fastener accessory for an article of clothing is disclosed and comprises an outer flange connected to an inner flange by a connecting segment, each flange extending outwardly tram the connecting segment a distance, wherein an aperture is present in each flange, wherein the aperture in the inner flange is adapted to have a portion of a fastener of an article of clothing extend therethrough and is larger than the outer flange aperture.

In another aspect of the present invention a fastener accessory for an article of clothing is disclosed and comprises an outer flange connected to an inner flange by a connecting segment, each flange extending outwardly from the connecting segment a distance, wherein an aperture is present in each flange, wherein the inner flange aperture is adapted to have a portion of a fastener of an article of clothing extend therethrough, wherein a cover piece is present on an outer surface of the outer flange and operatively connected to the outer flange, and wherein a protective device is present between the flanges and has a hardness less than a hardness of the outer flange.

In another aspect of the present invention an extender system for an article of clothing is disclosed and comprises an extension segment having a female fastener and a male fastener, wherein a flexible linking segment is operatively connected between the fasteners; and a fastener accessory comprising an outer flange connected to an inner flange by a connecting segment, each flange extending outwardly from the connecting segment a distance, wherein an aperture is present in each flange, wherein the aperture in the inner flange is adapted to have a portion of a fastener of an article of clothing extend therethrough and is larger than the outer flange aperture, and wherein the male fastener of the extension segment has a portion that is extendable through the aperture of the inner flange of the fastener accessory and adapted to be connected to a female fastener on the article of clothing.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
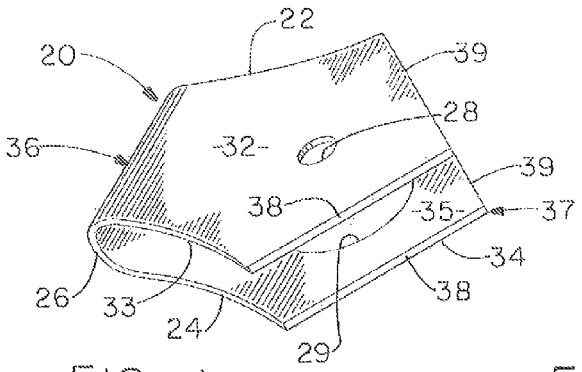
FIG. 1 is a left perspective view of one embodiment of a fastener accessory of the present invention including an outer flange and an inner flange each having apertures.
Figure 2:
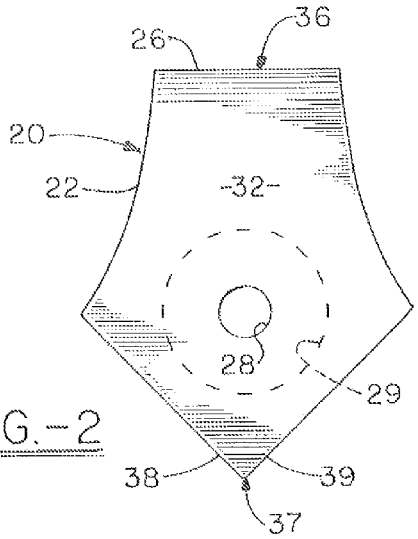
FIG. 2 is a top view of the fastener accessory illustrated in FIG. 1.
Figure 3:
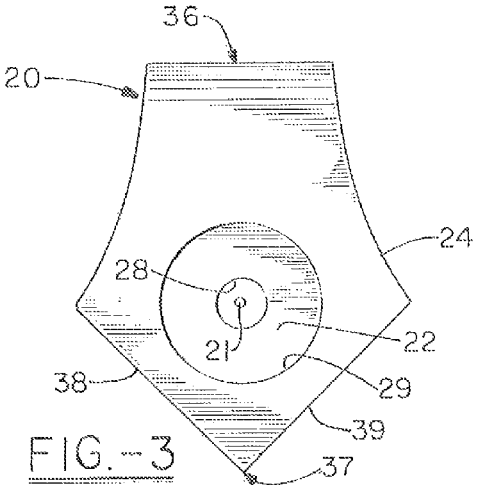
FIG. 3 is a bottom view of the fastener accessory illustrated in FIG. 1, wherein the outer flange aperture is illustrated being concentric with the aperture of the lower flange.

This description of useful embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

It is often desirable to provide an article of clothing such as a jacket or vest with extra ventilation or airflow, for example when riding a motorcycle or even greater girth in some cases. It is also often desirable to prevent the article of clothing from blowing open or backwards while walking or riding. Additionally, it is desirable to adorn articles of clothing with decorative items such as pins, buttons or the like. Currently, some vest extenders or vest chains used by motorcyclists include a decorative cover piece. However, when connected to the article of clothing, it is believed some articles have an unbalanced look. A further problem is to provide a fastener accessory that can be connected and disconnected from an article of clothing at will, and without causing damage or any permanent alteration to the article.

Figure 7:
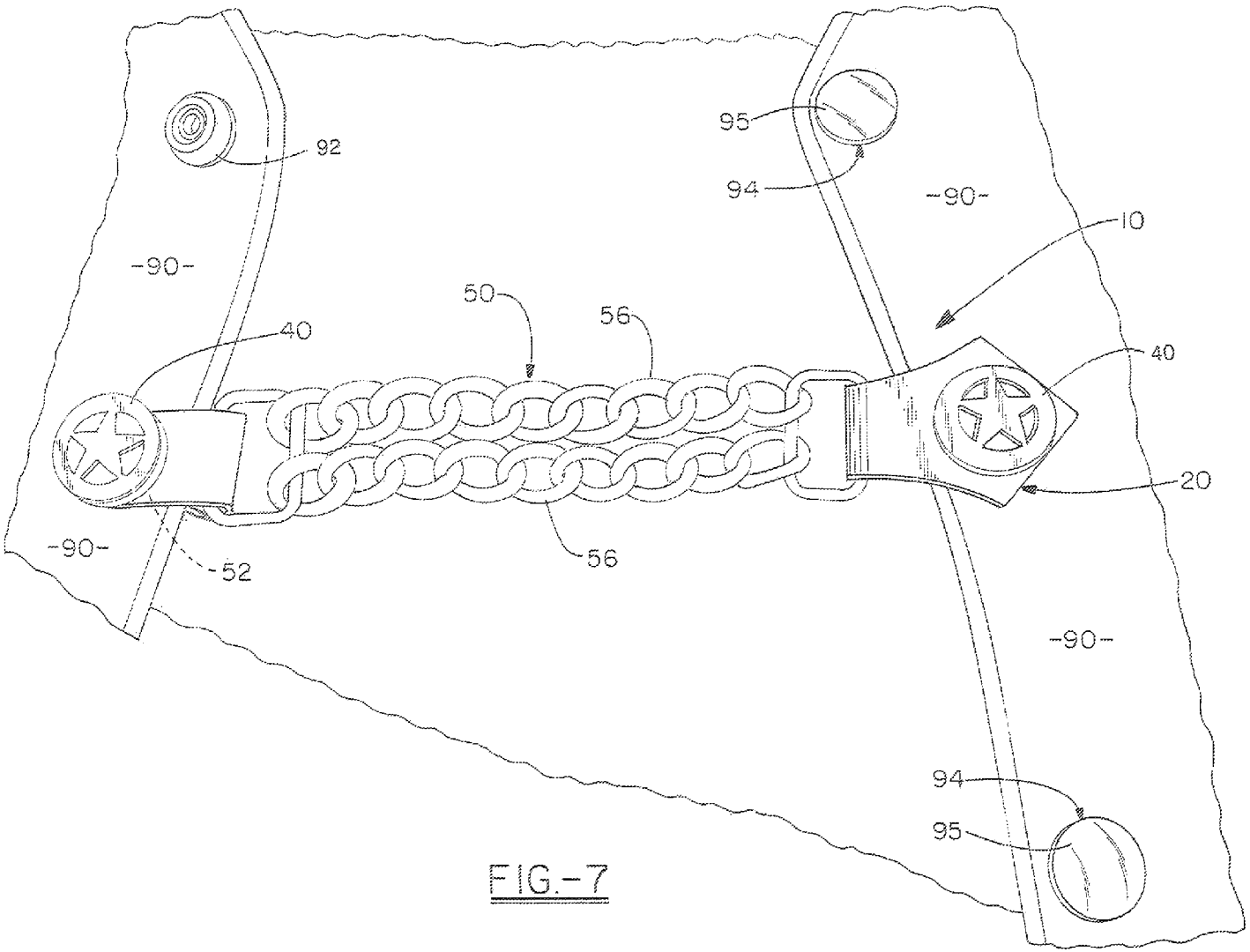
FIG. 7 is a front view of the one embodiment of the extender system of the present invention including a fastener accessory, cover piece at an extension segment operatively connected to an article of clothing.
Figure 8:
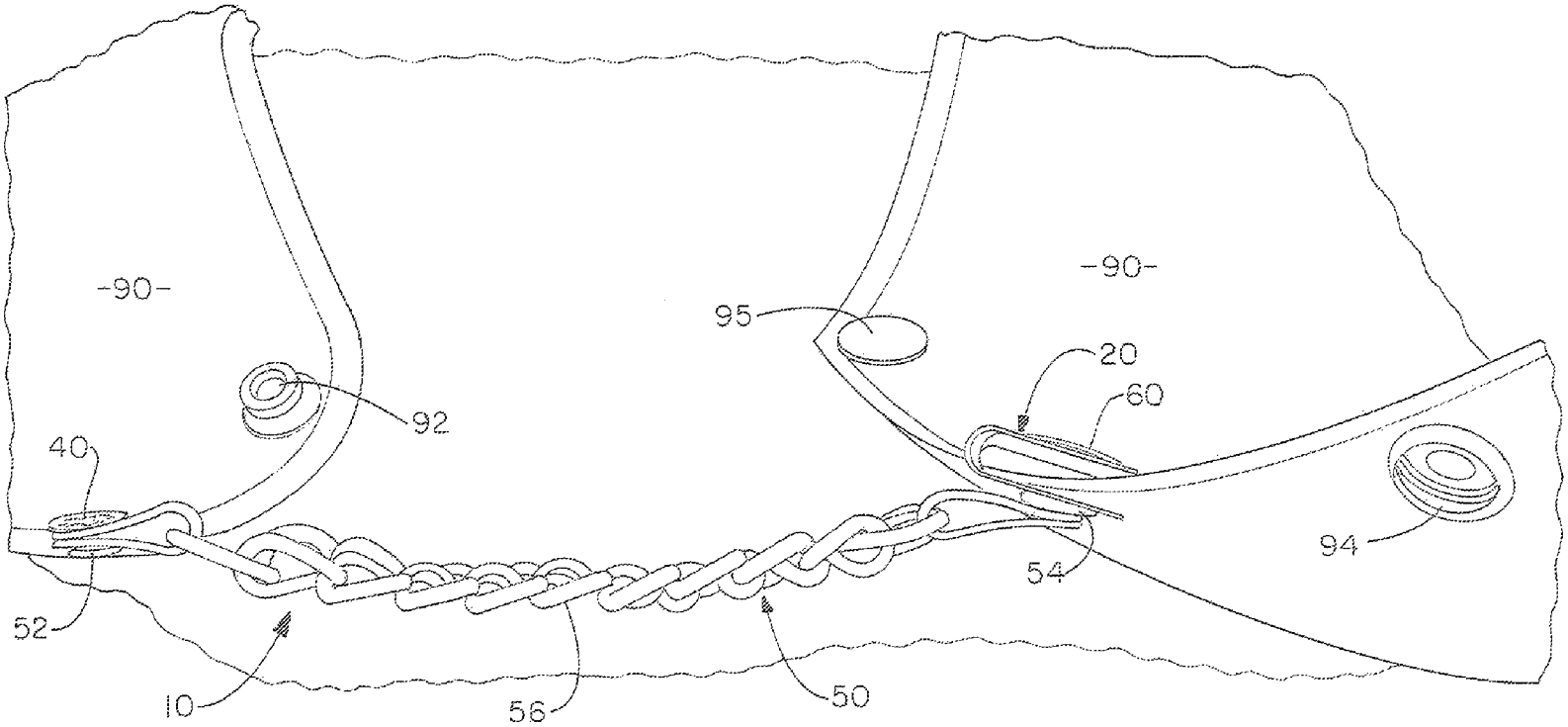
FIG. 8 is a side view of the embodiment illustrated in FIG. 7, wherein the fastener accessory is shown having its inner flange captured between the male fastener of the extension segment and the female fastener of the article of clothing.

The problems of the invention are solved by the extender system of the present invention. One embodiment of an extender system 10 is illustrated in FIGS. 7 and 8. The extender system 10 generally comprises a fastener accessory 20 and an extension segment 50. As illustrated, the extender system 10 comprises a pair of cover pieces 40 that provide a balanced look to the article of clothing 90 that is aesthetically pleasing, while still maintaining and not interfering with the functionality of the extender system 10.

One embodiment of a fastener accessory 20 is illustrated in FIGS. 1-6. The fastener accessory 20 has an outer flange 22 spaced a distance from an inner flange 24, the flanges 22, 24 connected at a base, rear first end 36 by a connecting segment 26. In one embodiment, the connecting segment 26 is substantially rounded or U-shaped.

In other embodiments, the connecting segment 26 can include other shapes or designs in order to mimic or compliment the corresponding section of an extension segment 50.

Outer flange 22 has an outer surface 32 and an inner surface 33. Likewise, the inner flange 24 includes outer surface 34 and inner surface 35. Inner surfaces 33 and 35 of the flanges 22 and 24 generally face each other. In one embodiment the outer flange 22 and inner flange 24 are substantially planar and disposed parallel to each other. Each flange 22, 24 includes an aperture 28 and 29, respectively, in one embodiment. In some embodiments aperture 28 may not be present if a cover piece 40 is desired to be connected to outer surface 32 of outer flange 22 through a connection element other than aperture 28. Cover piece 40 may be connected in other embodiments for example utilizing an adhesive, such as a glue or cement.

The fastener accessory 20 has first end 36 and a front or second end 37. In one embodiment, the second end 37 of each flange 22, 24 has a peak which can be pointed or rounded, for example. Located on either side of the apex is a first side 38 and a second side 39 that are generally linear along at least a portion thereof in one embodiment. Accordingly, an angle is formed between first side 38 and second side 39 that ranges generally from about 45° to about 135°, desirably from about 80° to about 100° and preferably is about 90° in some embodiments, such as illustrated in FIG. 1.

Aperture 28 is designed to accept a portion of a cover piece 40, such as a post in order to connect the cover piece 40 to the outer flange 22. Preferably, the aperture 28 is circular and thus has a diameter in one embodiment. The diameter of aperture 28 ranges generally from about 3.0 to about 6.5 millimeters, and preferably from about 4.0 to about 4.50 millimeters.

Inner flange 24 includes an aperture 29 adapted to have a portion of a male fastener 54 of an extension segment 50 extend therethrough, with the male fastener being connectable in a female fastener 94 of an article of clothing 90, such as illustrated in FIGS. 7 and 8, thus connecting the fastener accessory at a desired location in relation to the article of clothing 90. In one embodiment, the lower flange aperture 29 has a diameter that ranges from about 12.5 to about 16.0 millimeters and preferably from about 14.0 to about 14.5 millimeters.

In various embodiments, the diameter of the aperture 29 of inner flange 24 is at least 50 percent greater than the diameter of aperture 28 of outer flange 22, and preferably at least 60 percent greater in other embodiments. In a preferred embodiment the aperture 28 is concentric with the aperture 29, and thus the apertures share a common center point 21, see FIG. 3. In some other embodiments the apertures can be offset.

In order for fastener accessory 20 to be positioned over or around a female fastener 94 of article 90, a minimum distance must be present between inner surface 33 of outer flange 22 and inner surface 35 of inner flange 24. A separation distance 31, see FIG. 4 for example, can vary depending upon the thickness of female fastener 94 and article 90. That said, separation distance 31 ranges generally from about 4.5 to about 8.0 millimeters, and preferably from about 6.0 to about 6.5 millimeters.

Additionally, the distance between first end 36 and second end 37 can vary, depending upon the location of the female fastener 94 of article 90. That said, the distance generally ranges from about 33.0 to about 37 millimeters and preferably from about 35 to about 35.5 millimeters.

Figure 4:
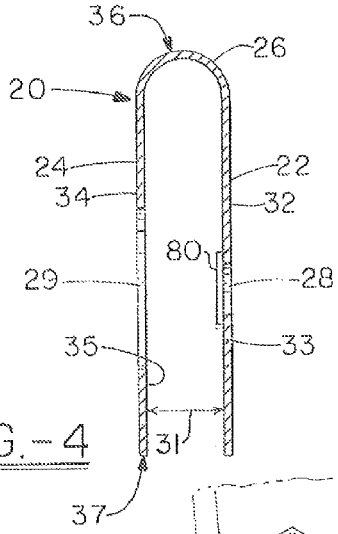
FIG. 4 is cross-sectional side view of the fastener accessory illustrated in FIG. 1 through the center of the apertures present in the outer and inner flanges.
Figure 5:
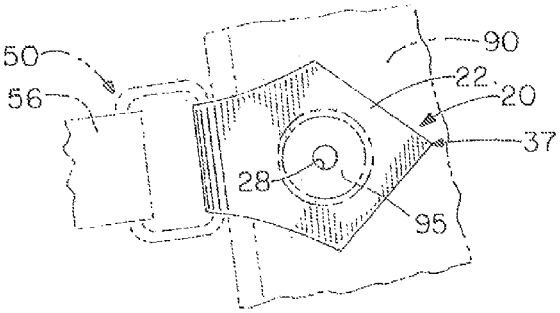
FIG. 5 is a top view showing the fastener accessory applied over a female fastener cover, in particular a snap button cover of an article of clothing.
Figure 6:
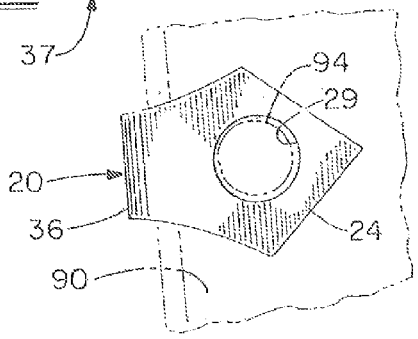
FIG. 6 is a bottom view of the fastener accessory shown in FIG. 4 as it attaches over the female anchor portion of the fastener, in particular a snap button.

In view of the inner surface 33 of outer flange 22 adapted to be disposed adjacent to a fastener cover of an article of clothing, such as illustrated in FIG. 7, at least a portion of the inner surface 33 is provided with a protective device 80, see FIG. 4, for example a protective coating, washer, or pad that is connected preferably permanently to inner surface 33 or operatively disposed adjacent to inner surface 33 in order to protect the fastener cover 95 from abrasion. That said, the protective device 80 has a hardness, e.g. a Shore hardness, less than a hardness of the outer flange 22 of the fastener accessory. When the outer flange 22 includes an aperture 28, the protective device 80 preferably includes an aperture, and can be in the form of a washer, for example. In one embodiment when the protective device is fashioned as a disk or washer-like component, the thickness can range from about 0.5 to about 3 millimeters. Desirably from about 1 to about 2 millimeters and preferably from about 1.25 to about 1.75 millimeters. The diameter can vary and is generally sufficient to provide protection to the fastener cover. That said, the outer diameter and some embodiments ranges from about 10 to about 17 millimeters, and preferably is about 15 to about 16 millimeters. When the protective device includes an aperture, the aperture diameter can range from about 4 to about 8 millimeters and is preferably from about 6 to about 6.5 millimeters.

As illustrated at least in FIGS. 7 and 8, the extension segment 50 includes a female fastener 52, adapted to be connected to a male fastener 92 of article 90. Additionally, the extension segment 50 includes a male fastener 54 connectable to a female fastener 94 of article 90. Female fastener 94 has a fastener cover 95 disposed on an outer surface of article 90 which is covered by fastener accessory 20 as illustrated in the Figures. Extension segment 50 also has a rigid or flexible linking segment 56 which can be generally of any length desired by the user and can be formed of generally any desired material, for example, chains, leather, rope, cord, Additionally, the portion of the extension segment 50 including the female fastener 52 is provided with a cover piece 40, such as shown in FIG. 7. In the embodiment illustrated in FIG. 7, the female fastener 52 of extension 50 is connected to linking segment 56 through a piece of material, for example a piece of leather as illustrated. The linking segment 56 illustrated comprises a plurality of links or chain segments. A second end of the linking segment 56 is connected to male fastener 54 operatively through an additional piece of material, for example leather as illustrated in the form of a loop like the other piece of material.

The extender system 10 can be utilized in one embodiment as follows. Female fastener 52 of extension segment 50 is connected to a male fastener 92 of article 90. The open end of fastener accessory 20 is extended over a portion of article 90 such as shown in FIGS. 7 and 8 such that outer flange 22 is disposed over fastener cover 95 and that female fastener 94 is accessible through aperture 29 of inner flange 24. Either before or after this connection, a portion of male fastener 54 of extension segment 50 is inserted through a portion of aperture 29 of inner flange 24 and operatively connected to female fastener 94 of article 90. As illustrated in FIG. 7, the arrangement provides a plurality of two, namely cover pieces 40 that are present on each side of the article of clothing 90 thereby providing a balanced, pleasing look and aesthetic appeal. As additionally described hereinabove, the fastener accessory can be utilized without the extension segment 50 as the same provides a decorative cover for a fastener, such as a snap.

While in accordance with the patent statutes, the best mode and preferred embodiment have been set forth, the scope of the invention is not limited thereto, but rather by the scope of the attached claims.

What is claimed is:

1. An extender system for an article of clothing, comprising:

an extension segment having a female fastener and a male fastener, wherein a linking segment is operatively connected between the fasteners, wherein a first cover piece is connected to the female fastener; and a fastener accessory comprising an outer flange permanently connected to an inner flange by a U-shaped connecting segment, each of the outer flange and the inner flange extending outwardly from the connecting segment a distance, wherein an aperture is present in each of the outer flange and the inner flange, wherein the aperture in the inner flange is adapted to have a portion of a fastener of an article of clothing extend therethrough and is larger than the outer flange aperture, wherein a second cover piece is present on an outer surface of the outer flange and is connected solely to the outer flange, wherein a portion of the cover piece extends through the outer flange aperture, wherein the male fastener of the extension segment has a portion that is extendable through the aperture of the inner flange of the fastener accessory and adapted to be connected to a female fastener on the article of clothing, wherein the first cover piece and the second cover piece are thus present on each side of the extender system and are adapted to provide a balanced look with respect to the cover pieces on the article of clothing.

2. The extender system according to claim 1, wherein the diameter of the outer flange aperture ranges about 3 to about 6.5 millimeters, and wherein the diameter of the inner aperture flange ranges about 12.5 to about 16 millimeters, wherein a separation distance of about 4.5 to about 8 millimeters is present between the outer flange and the inner flange, and wherein the distance between a first end and a second end of the accessory ranges about 33 to about 37 millimeters.

3. The extender system according to claim 1, wherein the inner flange aperture has a diameter larger than a diameter of the outer flange aperture, wherein the apertures are concentric, and wherein an inner side of the outer flange comprises or is operatively connected to a protective device having a hardness less than a hardness of the outer flange.

4. The extender system according to claim 3, wherein the diameter of the outer flange aperture ranges about 3 to about 6.5 millimeters, wherein the diameter of the inner flange aperture ranges about 12.5 to about 16 millimeters, wherein a separation distance of about 4.5 to about 8 millimeters is present between the outer flange and the inner flange, and wherein the distance between a first end and a second end of the accessory ranges about 33 to about 37 millimeters.

* * * * *